US010096218B2

(12) United States Patent
Burns et al.

(10) Patent No.: US 10,096,218 B2
(45) Date of Patent: Oct. 9, 2018

(54) PORTAL WITH RFID TAG READER AND OBJECT RECOGNITION FUNCTIONALITY, AND METHOD OF UTILIZING SAME

(75) Inventors: Gary P. Burns, Rockford, MI (US); Peter Phaneuf, Grand Rapids, MI (US); Michael Isabell, Grand Rapids, MI (US)

(73) Assignee: eAgile, Inc., Grand Rapids, MI (US)

( * ) Notice: Subject to any disclaimer, the term of this patent is extended or adjusted under 35 U.S.C. 154(b) by 688 days.

(21) Appl. No.: 13/615,035

(22) Filed: Sep. 13, 2012

(65) Prior Publication Data

US 2013/0063567 A1 Mar. 14, 2013

Related U.S. Application Data

(60) Provisional application No. 61/534,010, filed on Sep. 13, 2011.

(51) Int. Cl.
*G08B 13/24* (2006.01)

(52) U.S. Cl.
CPC ..... *G08B 13/248* (2013.01)

(58) Field of Classification Search
USPC ..... 348/46
See application file for complete search history.

(56) References Cited

U.S. PATENT DOCUMENTS 6,641,042 B1 11/2003 Pierenkemper et al.
2003/0019933 A1* 1/2003 Tsikos ..... G02B 26/10 235/454
2008/0100706 A1 5/2008 Breed
2008/0258914 A1 10/2008 Kondo et al.
2009/0321525 A1 12/2009 Barkan
2012/0075464 A1* 3/2012 Derenne et al. ..... 348/135

FOREIGN PATENT DOCUMENTS

EP 1079322 A1 2/2001
EP 2012253 A1 1/2009

OTHER PUBLICATIONS

Kinect, From Wikipedia, the free encyclopedia, undated web pages, accessed from the Internet Aug. 15, 2011, 7 pages.
PrimeSense Natural Interaction, Reference Design, undated web pages, accessed from the Internet Aug. 15, 2011, 2 pages, Copyright 2010 PrimeSense Ltd.

* cited by examiner

*Primary Examiner* — Mikhail Itskovich
(74) *Attorney, Agent, or Firm* — McGarry Bair PC

(57) ABSTRACT

An RFID/object recognition system monitors the passage of an object through a portal into a space. An RFID reader adjacent the portal communicates with an RFID tag within a preselected distance from the RFID reader. A data processor processes data from the RFID reader. A 3-dimensional scanner has an RGB camera and a depth sensor with an infrared laser projector and a monochrome CMOS sensor. An infrared laser controller is electronically coupled with the infrared laser projector, and a monochrome CMOS processor is electronically coupled with the monochrome CMOS sensor. The infrared laser controller, monochrome CMOS processor, and RGB camera are electronically coupled with a processor. The RFID reader receives data from an RFID tag when an RFID-tagged object passes within the preselected distance from the RFID reader through the portal. The 3-dimensional object recognition assembly identifies where the RFID-tagged object is located within the defined space.

17 Claims, 4 Drawing Sheets

PORTAL WITH RFID TAG READER AND OBJECT RECOGNITION FUNCTIONALITY, AND METHOD OF UTILIZING SAME

CROSS-REFERENCE TO RELATED APPLICATION

This application claims the benefit of U.S. provisional application Ser. No. 61/534,010, filed Sep. 13, 2011, which is incorporated by reference herein in its entirety.

BACKGROUND OF THE INVENTION

Field of the Invention

The invention relates to a portal incorporating an RFID tag reader for notification of the passage of an RFID tag through the portal, and a 3-D visual recognition system for identifying an object to which the RFID tag is attached.

Description of the Related Art

Portal readers are utilized at portals, such as open passageways, man doors, hallways, garage doors, stockyard gates, and the like, to monitor the passage of objects having RFID tags through the portal, and record information transmitted to the portal reader from the RFID tags. The information provided by an RFID tag can include data concerning the object to which the RFID tag is attached.

A portal reader detects the presence of a signal from an RFID tag. However, a portal reader does not "see" the tag from which it is receiving the signal, nor can it differentiate between objects to which RFID tags are attached. A problem frequently encountered with portal readers is the tendency to record information from RFID tags that have not actually passed through the portal. For example, an object with an attached RFID tag may pass a portal reader within the range of the RFID tag without passing through the portal, i.e. passing along and parallel to the portal. These are frequently referred to as "stray reads."

Photo-eye sensors can be mounted at an appropriate location relative to the portal in order to trigger a portal reader when the object encounters the sensor line-of-sight and passes through the portal. Analytical techniques or algorithms can be utilized to estimate the direction of travel and speed of a tag from the signal sent by the tag. Data analysis can be performed utilizing received signal strength indication (RSSI), phase analysis, or Doppler analysis.

Such techniques suffer from an inability to provide more than an estimate of whether a tag has passed through a portal or not. Thus, there is a need for a system providing both information from an RFID tag and verification that the tag has passed through the portal.

BRIEF DESCRIPTION OF THE INVENTION

An RFID/object recognition system monitors the passage of an object through a portal into a space. An RFID reader adjacent the portal communicates with an RFID tag within a preselected distance from the RFID reader. A data processor processes data from the RFID reader. A 3-dimensional scanner has an RGB camera and a depth sensor with an infrared laser projector and a monochrome CMOS sensor. An infrared laser controller is electronically coupled with the infrared laser projector, and a monochrome CMOS processor is electronically coupled with the monochrome CMOS sensor. The infrared laser controller, monochrome CMOS processor, and RGB camera are electronically coupled with a processor. The RFID reader receives data from an RFID tag when an RFID-tagged object passes within the preselected distance from the RFID reader through the portal. The 3-dimensional object recognition assembly identifies where the RFID-tagged object is located within the defined space.

DESCRIPTION OF AN EMBODIMENT OF THE INVENTION

The invention described and illustrated herein is addressed to RFID applications enhanced by 3-D object recognition. RFID tags can be affixed to objects, such as tools, parts, raw materials, supplies, and the like. The RFID tags can be monitored utilizing RFID readers placed at different locations adjacent to which the RFID tags can pass to identify where the RFID tags, and the objects to which they are affixed, are located. Because an RFID tag is merely "read" by RFID readers, an object to which the RFID tag is affixed is identified only by data provided by the RFID tag to the RFID readers.

As an example, if a pair of tools is removed from a storage cubicle, each one having an RFID tag affixed thereto, an RFID reader should identify two RFID tags, thus indicating movement of two tools. However, if one of the RFID tags is no longer affixed to a tool, the RFID readers will identify only movement of a single tool. The untagged tool will no longer be accounted for.

Similarly, if a first object is removed from a storage cubicle, but with a substituted RFID tag affixed thereto containing data applicable to a second, different object, the RFID reader will record the removal of the second object when, in actuality, the first object has been removed.

As another example, personnel are frequently issued RFID-tagged identification plates that are to be worn or otherwise carried. RFID readers can monitor the movement of personnel for safety, security, and administrative purposes. However, if personnel exchange identification plates or otherwise carry an identification plate having an RFID tag with inaccurate information, the individual to whom the identification plate is assigned will not be accurately accounted for.

3-D object recognition can be utilized to confirm the information delivered by an RFID tag. For example, a 3-D image of a tool, personnel, products, or other objects, can be obtained during the reading of the RFID tag. If the RFID reader indicates the presence of a single RFID tag, and thus a single person or object, but 3-D object recognition indicates a greater or lesser number of personnel or objects, corrective action can be promptly taken. Similarly, if an RFID reader indicates the presence of an RFID tag associated with a specific individual, or object, but 3-D object recognition indicates a different individual or object, corrective action can be promptly taken. This composite RFID/ object recognition system can eliminate instances of unauthorized or absent personnel, theft of tools, parts, raw materials, and supplies, elimination of erroneous shipments of products, and the like.

Figure 1:
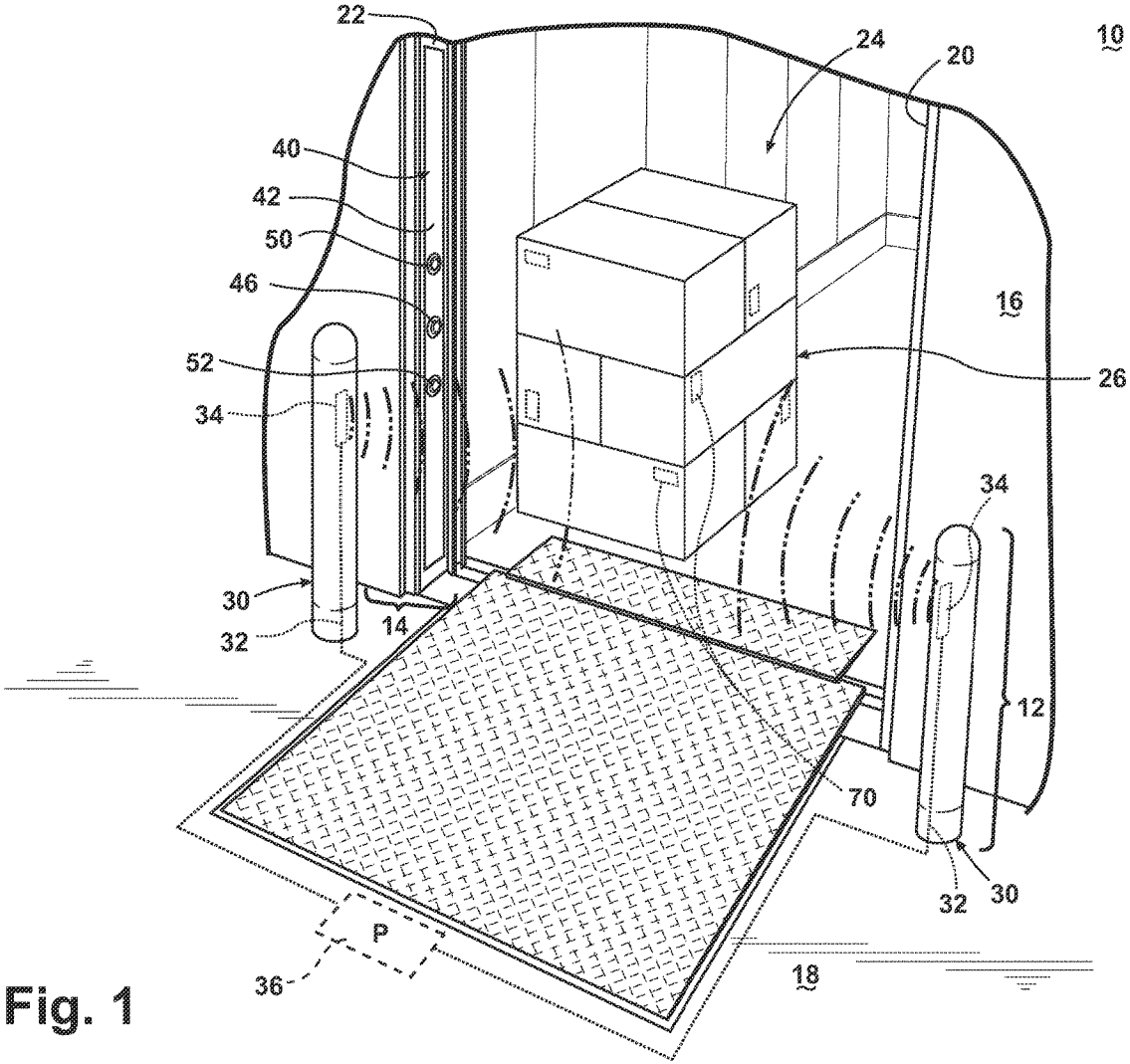
FIG. 1 is a perspective, partly schematic view of a loading dock including an exemplary embodiment of a portal with an RFID tag reader and a 3-D object recognition assembly.

Referring to the drawings, and particularly to FIG. 1, an exemplary embodiment of an RFID/object recognition system 10 is illustrated as associated with a loading dock portal 20, the loading dock comprising a wall 16, a floor 18, and a frame 22 forming a portion of the portal 20. The system 10 includes an RFID reader system 12, and a 3-D object recognition system 14 providing a three-dimensional image of an object 26 passing through the portal 20, while loaded onto or unloaded from a delivery vehicle 24.

FIG. 1 illustrates a pair of RFID assemblies 30, including a pair of RFID readers 34 capable of actuating and receiving signals from an RFID tag 70 associated with an object 26 passing through the portal 20. While FIG. 1 illustrates a pair of RFID assemblies 30, a greater or smaller number of RFID assemblies 30 can be selected based upon factors such as portal dimensions, reader range and sensitivity, object size, and the like. An RFID reader 34 can be electronically coupled with a processor 36 for processing data signals sent by the reader 34. Wired or wireless technology can be utilized to couple the RFID readers 34 with the processor 36.

Figure 2:
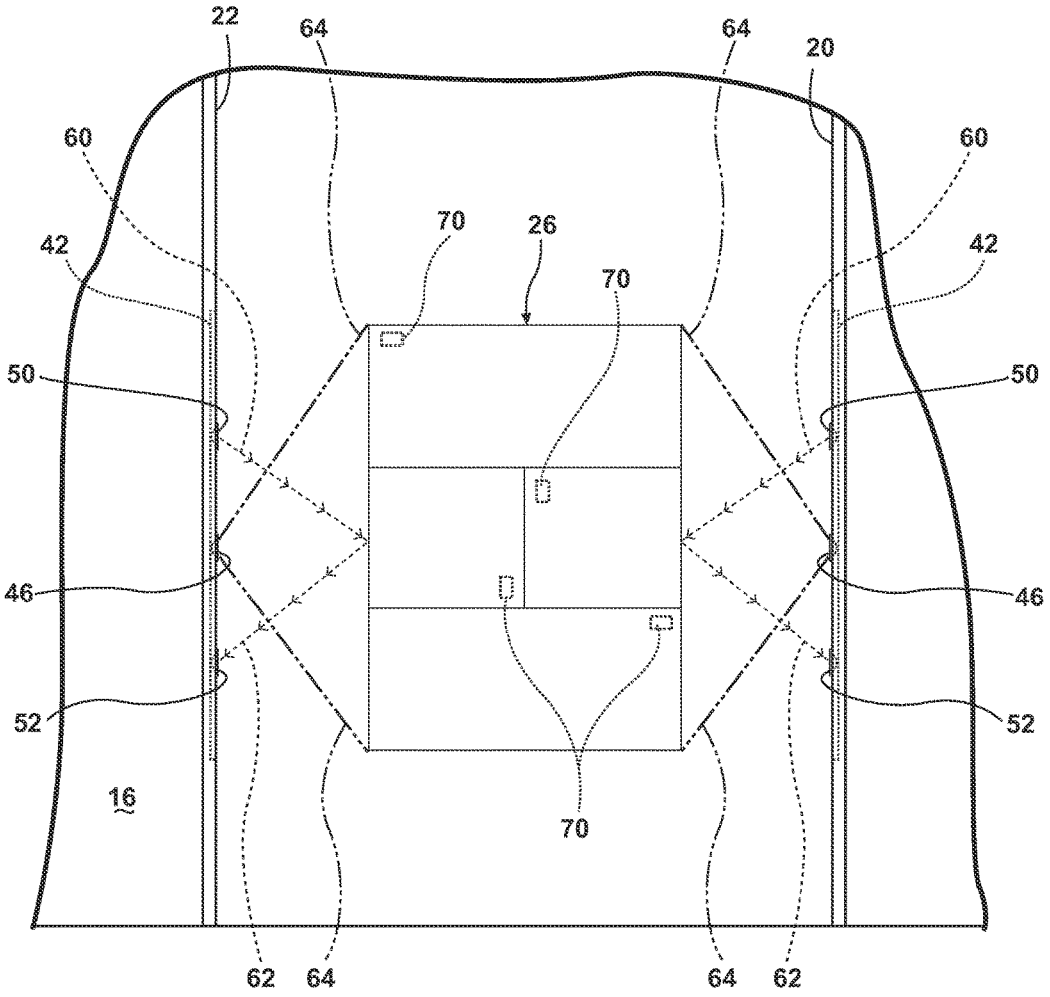
FIG. 2 is an elevation view of the loading dock of FIG. 1 illustrating the operation of a 3-D object recognition assembly.

FIG. 1 also illustrates the 3-D object recognition system 14 including a 3-D object recognition assembly 40. The assembly 40 is illustrated mounted to the portal frame 22 on one side of the portal 20. As illustrated in FIG. 2, a plurality of recognition assemblies 40 can be incorporated into the portal frame 22 to ensure that an accurate image of the object 26 can be recovered. Factors such as the geometries of the portal and the object, the sensitivity of the electronic devices, signal interference, and the like, can be considered in determining the precise configuration of a 3-D object recognition system 14.

Figure 3:
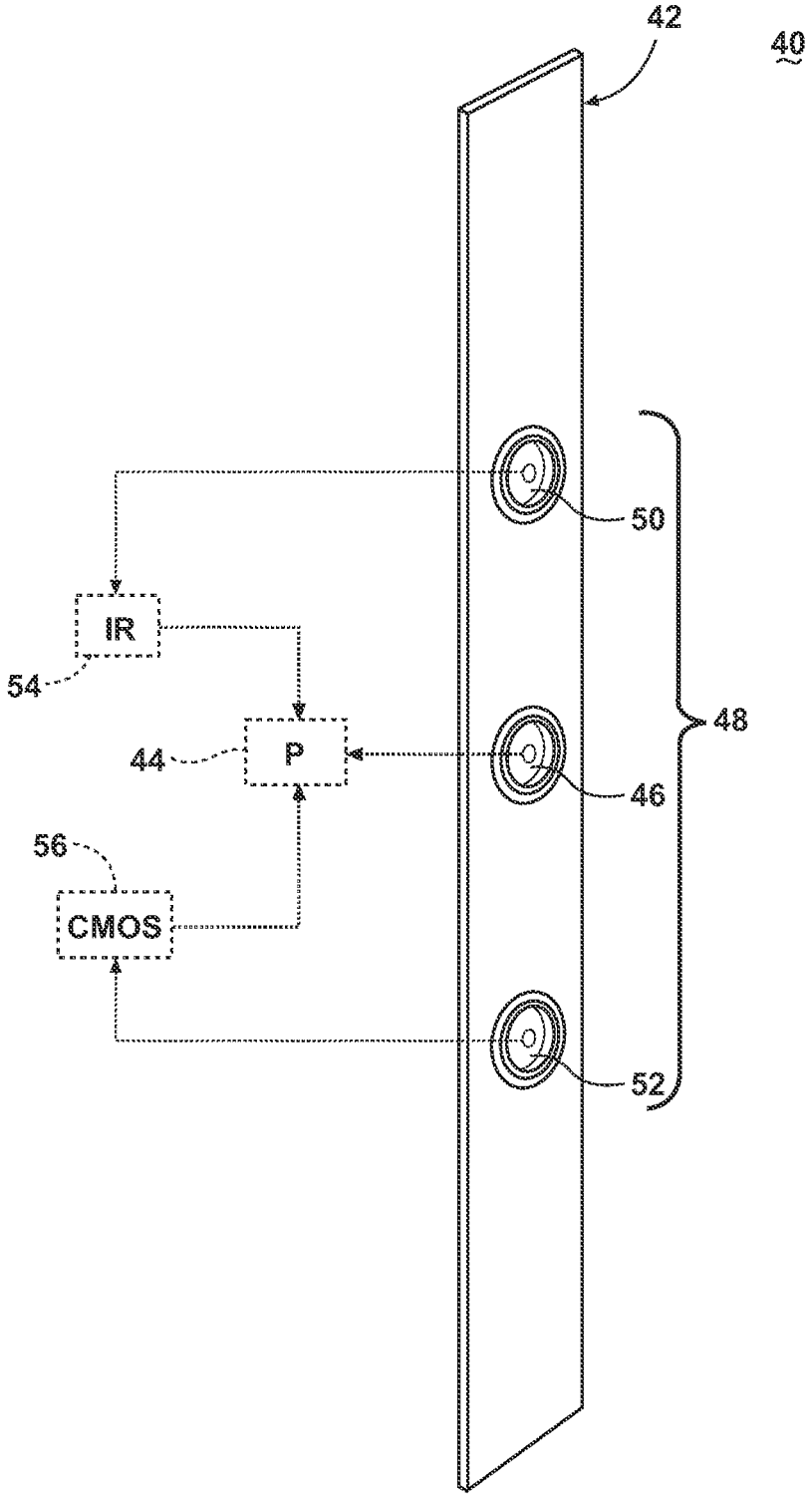
FIG. 3 is a perspective, partly schematic view of an object recognition assembly illustrated in FIG. 1.

Referring also to FIG. 3, the 3-D object recognition assembly 40 can include a 3-D scanner 42. The scanner 42 can include an RGB camera 46 and a depth sensor 48. The depth sensor 48 can include an infrared laser projector 50 and a monochrome CMOS sensor 52. An example of such a 3-D scanner 42 is utilized in the KINECT™ video gaming system developed by Microsoft® and PrimeSense® Ltd. of Tel-Aviv, Israel. The infrared laser projector 50 can be electronically coupled with an infrared laser controller 54, and the monochrome CMOS sensor 52 can be electronically coupled with a monochrome CMOS processor 56. The infrared laser controller 54, the monochrome CMOS processor 56, and the RGB camera 46 can be electronically coupled with a processor 44.

Information from the infrared laser controller 54, monochrome CMOS processor 56, and RGB camera 46 can be processed into 3-D images by the processor 44 utilizing selected software developed specifically for such purposes. An example of such software is that developed by Microsoft® for use in the KINECT™ system.

The 3-D object recognition assembly 40 can operate as follows. Referring to FIG. 2, the infrared laser projector 50 can transmit a laser beam 60 having an infrared frequency in an orientation wherein an object 26 can passed through the beam. When the beam 60 encounters an object, it can be reflected (reflected light ray 62) to the monochrome CMOS sensor 52. Concurrently, the RGB camera 46 can capture an image of the object 26 in the RGB field of view. Data output from the CMOS sensor 52 and RGB camera 46 can be processed by the processor 44 to provide a 3-D image of the object 26. Data transmitted by the RFID tag 70 to the RFID reader 34 can also be processed and correlated with the 3-D image to confirm that the information encoded on the RFID tag 70 is correctly that of the object 26.

The 3-D object recognition system 14 can be used to identify by shape those subjects that pass by the RFID reader 34 through the portal 20. Use of the 3-D object recognition system 14 can improve the accuracy and reliability of the subject identification process. In effect, the system "sees" a subject passing through the portal, and confirms that the data received from an RFID tag is properly associated with the subject.

Figure 4:
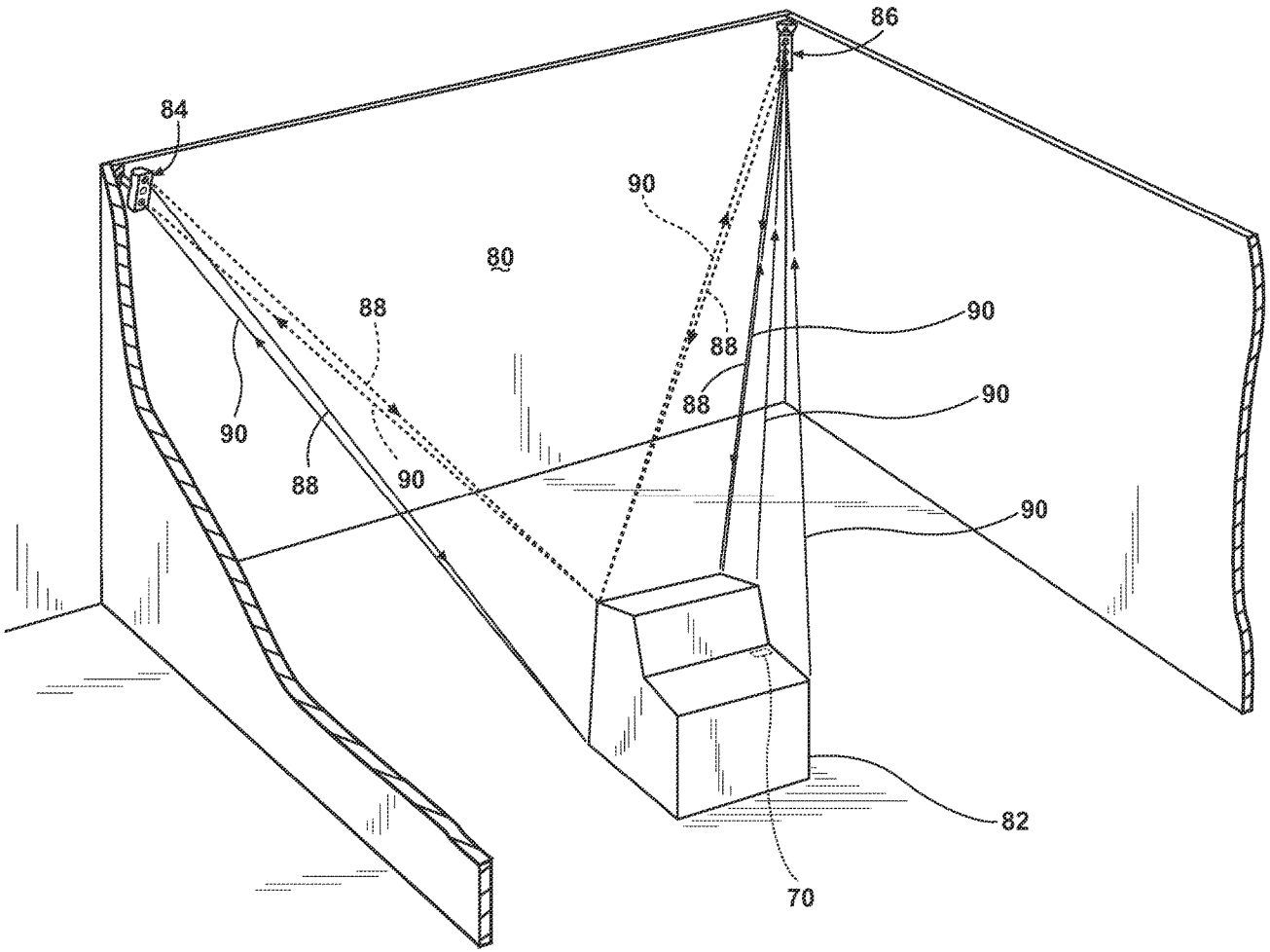
FIG. 4 is a perspective, partly cut-away view of an object in a room having an operating pair of 3-D object recognition assemblies illustrated in FIG. 3.

As illustrated in FIG. 4, a storage room 80 can be outfitted with several 3-D object recognition assemblies 84 mounted at locations appropriate to the monitoring program selected. Such 3-D object recognition assemblies 84 can be identical in configuration and operation to the 3-D object recognition assembly 40 described previously herein. As an example, a pair of 3-D object recognition assemblies 84 is shown in FIG. 4 mounted in adjacent upper corners of the storage room 80 to enable an object 82 to be scanned. Alternatively, more than a single pair of 3-D object recognition assemblies can be utilized at locations throughout the storage room 80 at different heights and with different orientations to ensure optimal accurate scanning of an object 82 having an affixed RFID tag 70.

As described previously herein, the 3-D object recognition assemblies 40 can scan the object 82 with infrared laser beams 88 which are reflected from the object back to the 3-D object recognition assemblies 40 as reflected light beams 90. It should be noted that two reflected light beams 90 are shown without correlating infrared laser beams 88 for purposes of clarity. The several 3-D object recognition assemblies 40 can provide a three-dimensional perspective to the object 82 that is missing with a two-dimensional image. Thus, the object 82 can be more completely identified by utilizing the RFID tag, with the RGB camera, and the infrared laser projector and monochrome CMOS sensor.

In addition to loading docks, the RFID/object recognition system can be incorporated into open passageways, man doors, hallways, garage doors, stockyard gates, and the like, to monitor the passage of RFID-tagged subjects through the portal. For example, the system can facilitate the use of pattern recognition to determine the type of object, e.g. shipping containers, pallets, personnel, lift-trucks with or without a load, livestock, and the like, identified by an associated RFID tag. Pattern recognition can also be used to estimate the number of expected tagged items in the field.

The RFID/object recognition system can be used to calculate the speed of subject(s) passing through a portal for comparison and confirmation with RSSI/Phase/Doppler data, or to determine the speed and direction of tagged subjects without employing photoelectric sensors or phase data analysis.

Personnel can be accurately tracked by comparing data from RFID tags carried by the personnel with each individual's physical characteristics, thereby enhancing security and safety. For example, an individual issued specific RFID-tagged identification is a known height recorded on the RFID tag, but the individual in possession of the identification badge is a different height. The same tracking program can be structured around other characteristics, such as facial recognition, body type analysis, and the like.

Where personnel can check out RFID-tagged equipment, supplies, materials, and the like, from a check-out station or stockroom, the RFID/object recognition system can enable a comparison of RFID data with the number or type of assets identified through object recognition. For example, two laptop computers are recognized during removal from the stockroom, but data from only one RFID tag is transmitted.

For chain-of-custody programs in which each item is tagged with an RFID tag, the RFID/object recognition system can record an image, either still or moving, each time an individual or sample/evidence passes through a portal and triggers the RFID reader. This can provide a backup means of identifying personnel in possession of the sample/evidence, thereby avoiding breaks in a chain-of-custody due to misplaced documentation, failure to properly prepare chain-of-custody documentation, other failures to properly follow established protocol, and the like.

While the invention has been specifically described in connection with certain specific embodiments thereof, it is to be understood that this is by way of illustration and not of limitation. Reasonable variation and modification are possible within the scope of the forgoing disclosure and drawings without departing from the spirit of the invention which is defined in the appended claims.

What is claimed is:

1. An object recognition system for identifying at least one object in a defined space, the system comprising:

at least one radio-frequency identification tag (RFID) reader disposed in a position relative to a defined space to effectively read an RFID tag in the defined space and output an RFID signal representing information on the RFID tag;

at least one 3-dimensional object (3-D) recognition assembly disposed in a position relative to the defined space to capture an image of an object in the defined space and output an image signal representing the image of the object; and a processor coupled to the at least one RFID reader and the at least one 3-D recognition assembly;

wherein the processor is configured to receive and process the RFID signal, to receive and process the image signal, and to determine whether the information on the RFID tag relates to the object in the image and if so, then to confirm the information on the RFID tag.

2. An RFID/object recognition system in accordance with claim 1 wherein the 3-dimensional object recognition system comprises an RGB camera, an infrared laser projector, a monochrome CMOS sensor, an infrared laser controller electronically coupled with the infrared laser projector, a monochrome CMOS processor electronically coupled with the monochrome CMOS sensor, and a 3-dimensional image processor electronically coupled with the infrared laser controller, the monochrome CMOS processor, and the RGB camera.

3. An RFID/object recognition system in accordance with claim 2 wherein the 3-D object recognition system comprises at least two 3-D object recognition assemblies so that the system can identify the location of the object within the defined space.

4. An RFID/object recognition system in accordance with claim 2 wherein the infrared laser controller can control the transmission of an infrared laser beam from the infrared laser projector to intercept object.

5. An RFID/object recognition system in accordance with claim 4 wherein the infrared laser beam can be reflected from the object to the monochrome CMOS sensor.

6. An RFID/object recognition system in accordance with claim 5 wherein the RGB camera can capture an image of the object concurrently with the transmission of the infrared laser beam from the infrared laser projector.

7. An RFID/object recognition system in accordance with claim 6 wherein the reflected infrared laser beam captured by the CMOS sensor can be correlatively processed with the image from the RGB camera to produce an image having a 3-dimensional perspective, thereby enabling the object to be accurately identified.

8. An RFID/object recognition system in accordance with claim 2 wherein the 3-D object recognition system comprises at least three spaced-apart 3-dimensional scanners for enhancing a 3-D perspective of an image of the object.

9. A method of correlating an object in a defined space to a radio-frequency identification (RFID) tag, the method comprising:

reading data from at least one RFID tag by an RFID tag reader disposed in a position relative to a defined space;

obtaining a 3 dimensional (3-D) image of an object in the defined space;

transmitting to at least one processor an RFID signal representing the data;

transmitting the 3-D image to the at least one processor;

processing the RFID signal and the image in the at least one processor;

and comparing the processed RFID signal with the 3-D image to determine whether the information on the RFID tag relates to the object in the image and if so, then to confirm the information on the RFID tag.

10. A method in accordance with claim 9, and further comprising obtaining more than one 3-D image of the object in the defined space.

11. A method in accordance with claim 10, and further undertaking corrective action if the information on the RFID tag does not relate to the object in the image.

12. A method in accordance with claim 9 wherein the object is one of an inanimate object, a person, an animal, or a plant.

13. A method in accordance with claim 9 wherein the 3-D image is obtained during the reading of the at least one RFID tag by the RFID tag reader.

14. The object recognition system of claim 1 wherein the defined space includes a portal and the at least one RFID reader is disposed at the portal and the 3-D recognition assembly is disposed to capture images at the portal.

15. A method in accordance with claim 9 further comprising processing the image with pattern recognition.

16. The object recognition system of claim 1 wherein the processor is further configured to process the image with pattern recognition.

17. A method in accordance with claim 9 wherein the defined space includes a portal and the at least one RFID reader is disposed at the portal and the 3-D recognition assembly is disposed to capture images at the portal.

* * * * *